US007622436B2

(12) United States Patent
Tuzi et al.

(10) Patent No.: US 7,622,436 B2
(45) Date of Patent: Nov. 24, 2009

(54) CLEANING COMPOSITION COMPRISING A TERNARY SURFACTANT SYSTEM IN COMBINATION WITH DIPROPYL OR DIISOPROPYL ADIPATE SOLVENT

(75) Inventors: Alexandrine Tuzi, Ans (BE); Guy Broze, Grace-Hollogne (BE)

(73) Assignee: Colgate-Palmolove Company, New York, NY (US)

( * ) Notice: Subject to any disclaimer, the term of this patent is extended or adjusted under 35 U.S.C. 154(b) by 0 days.

(21) Appl. No.: 12/363,808

(22) Filed: Feb. 2, 2009

(65) Prior Publication Data

US 2009/0137440 A1 May 28, 2009

Related U.S. Application Data

(63) Continuation of application No. 11/565,087, filed on Nov. 30, 2006, now abandoned.

(51) Int. Cl.
*C11D 1/83* (2006.01)
*C11D 3/44* (2006.01)

(52) U.S. Cl. ..... 510/427; 510/235; 510/237; 510/242; 510/289; 510/290; 510/333; 510/340; 510/341; 510/350; 510/351; 510/356; 510/357; 510/421; 510/422; 510/426; 510/432; 510/503

(58) Field of Classification Search ..... 510/235, 510/237, 242, 289, 290, 333, 340, 341, 350, 510/351, 356, 357, 421, 422, 426, 427, 432, 510/503
See application file for complete search history.

(56) References Cited

U.S. PATENT DOCUMENTS

| | | | | |
|---|---|---|---|---|
| 5,037,863 | A | 8/1991 | Kozakiewicz et al. | |
| 5,500,416 | A * | 3/1996 | Miyazawa et al. | 514/23 |
| 5,529,723 | A | 6/1996 | Drapier | |
| 5,578,298 | A | 11/1996 | Berthiaume et al. | |
| 5,580,848 | A | 12/1996 | Drapier | |
| 5,633,226 | A | 5/1997 | Owen et al. | |
| 5,780,415 | A * | 7/1998 | Leonard et al. | 510/417 |
| 5,840,676 | A | 11/1998 | Drapier et al. | |
| 5,851,976 | A | 12/1998 | Mertens | |
| 5,874,393 | A | 2/1999 | Drapier et al. | |
| 5,891,836 | A | 4/1999 | Kacher | |
| 5,939,378 | A | 8/1999 | Stringer et al. | |
| 5,962,396 | A | 10/1999 | Pollack et al. | |
| 6,004,920 | A | 12/1999 | Pollack et al. | |
| 6,008,180 | A | 12/1999 | Drapier et al. | |
| 6,020,296 | A | 2/2000 | Mertens et al. | |
| 6,030,935 | A | 2/2000 | Drapier et al. | |
| 6,281,182 | B1 | 8/2001 | Leonard et al. | |
| 6,475,973 | B1 | 11/2002 | Mondin | |
| 6,645,929 | B2 | 11/2003 | Leonard et al. | |
| 6,815,406 | B1 | 11/2004 | Szewczyk | |
| 6,884,764 | B2 | 4/2005 | Szewczyk et al. | |
| 6,984,269 | B2 | 1/2006 | Motson | |
| 2002/0143072 | A1 * | 10/2002 | Aust | 516/98 |
| 2004/0229767 | A1 | 11/2004 | Ford et al. | |
| 2005/0192196 | A1 | 9/2005 | Hutton et al. | |
| 2006/0165739 | A1 * | 7/2006 | Komesvarakul et al. | 424/401 |

FOREIGN PATENT DOCUMENTS

| | | | |
|---|---|---|---|
| GB | 2 318 801 | A1 | 5/1998 |

* cited by examiner

*Primary Examiner*—Charles I Boyer
(74) *Attorney, Agent, or Firm*—Michael F. Morgan

(57) ABSTRACT

Cleaning compositions are described comprising an aqueous component; an organic solvent; an anionic surfactant; an amine co-surfactant containing either (a) an N-oxide group or (b) a zwitterionic group; and a nonionic surfactant; in a form of a microemulsion or microemulsion preconcentrate. Methods of cleaning a hard surface using such compositions are also described.

4 Claims, No Drawings

CLEANING COMPOSITION COMPRISING A TERNARY SURFACTANT SYSTEM IN COMBINATION WITH DIPROPYL OR DIISOPROPYL ADIPATE SOLVENT

CROSS REFERENCE TO RELATED APPLICATION

This application is a continuation of U.S. patent application Ser. No. 11/565,087, filed Nov. 30, 2006, which claims benefit of U.S. Provisional Patent Application No. 60/740,885 filed Nov. 30, 2005, which is hereby incorporated by reference in its entirety.

BACKGROUND OF THE INVENTION

The present invention relates to liquid cleaning compositions in the form of microemulsions or microemulsion preconcentrates that have efficient degreasing and drainage capabilities, e.g., for use in cleaning kitchenware.

Microemulsions are stable liquid dispersions of water and oil, together with one or more surfactants and co-surfactants, usually homogeneous and (due to the small size of the microemulsion droplets) transparent. Microemulsions form spontaneously when the correct components (e.g., water, oil, and appropriate surfactant/co-surfactant) are present. Because of their thermodynamic stability and their ability to take up relatively high volumes of oily substances, e.g., in the internal phase of the particles in an oil-in-water microemulsion, microemulsion systems are of interest for cleaning solutions, such as dishwashing and other cleaning solutions for surfaces having high amounts of oil and grease. An ongoing need exists for improved microemulsion systems that yield beneficial cleaning effects.

BRIEF SUMMARY OF THE INVENTION

A cleaning composition comprising:

(i) an aqueous component;

(ii) an organic solvent;

(iii) an anionic surfactant;

(iv) an amine co-surfactant containing either (a) an N-oxide group or (b) a zwitterionic group; and (v) a nonionic surfactant;

wherein said composition is in the form of a microemulsion or microemulsion preconcentrate.

A cleaning composition comprising:

(i) an aqueous component;

(ii) an organic solvent chosen from a terpene, a lower alkyl ester or diester, a lower aliphatic alkanol, an optionally substituted aromatic alcohol, or a lower alkyl ether or diether;

(iii) an anionic surfactant;

(iv) an amine co-surfactant containing either (a) an N-oxide group or (b) a zwitterionic group; and (v) a nonionic surfactant;

wherein said composition is in the form of a microemulsion or microemulsion preconcentrate.

A cleaning composition comprising:

(i) water;

(ii) about 0.1 to about 10% dibutyl adipate;

(iii) about 6 to about 9% $C_{12-14}$ alcohol polyethylene glycol (ethoxy) ether sulfate;

(iv) about 3 to about 15% cocoamidopropylamine oxide or lauryl myristyl isopropyl amine oxide; and (v) about 3 to about 8% $C_{9-11}$ alkanol with a degree of ethoxylation of 5 moles.

A method of cleaning a hard surface comprising applying a cleaning composition as described herein to the surface and rinsing the surface with water.

DETAILED DESCRIPTION OF THE INVENTION

As used throughout, unless otherwise specified, all ratios as set forth herein are by weight, and all percentage amounts for formulation ingredients are by weight of the total finished formulation. Furthermore, all references cited herein are hereby incorporated by reference in their entireties. Where a conflict exists between the definition of a term used herein and that in a cited reference, the present disclosure controls.

The present invention is directed to compositions in the form of an oil-in-water water microemulsion or microemulsion preconcentrate. The compositions include an aqueous component, which may be, for example, water or any other hydrophilic solvent. In certain embodiments, the compositions are useful for cleaning hard surfaces such as countertops and other kitchen and bathroom surfaces, as well as dishes, flatware and kitchenware. The compositions remove grease efficiently, have homogeneity and clarity, foaming properties, and allow fast drainage with minimal residue.

As used herein, a "microemulsion" refers to a thermodynamically stable dispersion of water and oil that forms spontaneously upon mixture of oil, water and various surfactants. Microemulsion droplets have a mean diameter of about 6 to about 100 nm. Because microemulsion droplets are smaller than the wavelength of visible light, solutions comprising them are generally translucent or transparent, unless there are other components present that interfere with passage of visible light. In some embodiments, the microemulsions of the invention are substantially homogeneous. In other embodiments, the microemulsion particles may co-exist with other surfactant-mediated systems, e.g., micelles, hydrosols, and/or macroemulsions. Preferably, the microemulsions of the present invention are oil-in-water microemulsions. Preferably, the majority of the oil component, e.g., (in various embodiments, greater than about 50%, greater than about 75%, or greater than about 90%), is located in microemulsion droplets rather than in micelles or macroemulsion droplets. In various embodiments, the microemulsions of the invention are substantially clear.

As used herein, a "microemulsion preconcentrate" is a formulation comprising a surfactant and co-surfactant, and optionally aqueous and/or organic solvent, which, when introduced to aqueous solution, e.g., water, and/or a lipophilic substance (e.g., grease), will spontaneously form a microemulsion.

In certain embodiments, the compositions comprise an anionic surfactant, such as, e.g., a sulfate, for example a sulfate of a fatty alcohol, e.g., sodium lauryl sulfate, or sulfate of a polyethoxylated alkanol having the formula $$CH_3(CH_2)_m—(O—CH_2—CH_2)_n—OSO_3M$$

wherein:

M is a cation, e.g., an alkali metal, alkaline earth metal, ammonium or polyalkanol ammonium ion, e.g. $Na^+$, $K^+$, $Mg^{+2}$, $NH_4^+$, or di or triethanol or propanol ammonium salt;

m is 6-14, preferably 11-12; and n represents an average degree of about 1 to about 9 moles of ethoxylation for the mixture, preferably about 2 moles; e.g., $C_{12-13}$ alcohol polyethylene glycol (ethoxy) ether sulfate.

Other useful sulfates include, e.g., a sulfate comprising a mixture of $C_{12-14}$ alcohol polyethylene glycol, e.g., surfactants available under the trade name Safol® 23E2S (Sasol Olefins and Surfactants GmbH, Hamburg, Germany).

In various embodiments, the anionic surfactant is present in the compositions in an amount of about 4.5 to about 10.5%, about 6 to about 9%, or about 7 to about 8.5%.

Anionic surfactants used in the compositions of the present invention are preferably sulfonates of a mixture of higher aliphatic alcohols containing 10-15 carbon atoms, preferably $C_{12-13}$ alkanol, condensed with an average of about 1 to about 9 moles of ethylene oxide, preferably 2 moles to form ethoxylated polyethylene glycol ether sulfate. A preferred anionic surfactant useful for the compositions of the present invention is a mixture of $C_{12-14}$ polyethylene glycol sulfate sodium salt, with an average degree of ethoxylation of 2 moles, e.g., Safol® 23E2S (Sasol Olefins and Surfactants GmbH, Hamburg, Germany). Other examples of useful anionic surfactants include: sulfonates or carboxylates of optionally substituted aromatic or aliphatic alcohol, i.e., sulfonates or carboxylates of alkanol, phenol, arylalkanol, alkylphenol, olefinic alcohol as well as other anionic surfactants known in the art. Further examples of anionic surfactants useful for the present invention include, for example, other alcohol ether sulfates such as, e.g., commercially available sodium, ammonium, monoisopropanol or triisopropanolammonium laureth sulfate marketed by Sasol Olefins and Surfactants GmbH (Hamburg, Germany).

The compositions may further comprise a nonionic surfactant. In certain embodiments, the nonionic surfactant has an HLB value of about 8 to about 14, e.g. a mixture of polyethoxylated alkanol of the general formula:

$$CH_3(CH_2)_m—(O—CH_2—CH_2)_n—OH$$

wherein m is from 8-12, and n represents an average degree of ethoxylation for the mixture, e.g. 2-8 moles, preferably 5 moles, e.g. Neodol™ 91-5. In various embodiments, the nonionic surfactant is present in an amount of about 0.5 to about 10%, about 1.5 to about 7% and about 2 to about 5% by weight. In certain embodiments, the nonionic surfactant is a mixture of $C_{9-11}$ alkanol with an average degree of ethoxylation of about five (5) moles, e.g. Neodol™ 91-5 (Shell Chemicals, Inc. USA).

Nonionic surfactants useful for the compositions of the present invention include, for example, amphipathic surface active compounds comprising (1) a hydrophobic end, which typically contains more than 7 carbon atoms, preferably 7-15 carbon atoms; (2) a hydrophilic end bearing no charge or a neutral charge; and (3) at least an average degree of ethyoxylation of about 2 moles. Examples of nonionic surfactants include, for example: optionally substituted aliphatic or aromatic alcohol ethoxylates, e.g., alkanol ethoxylates, phenol ethoxylates or alkylphenol ethoxylates. Other useful nonionic surfactants with respect to the compositions of the present invention include, for example, Neodol™ ethoxylates (Shell Company, USA), which are higher aliphatic, primary alcohols containing about 9-15 carbon atoms, e.g. $C_9$-$C_{11}$ alkanol, condensed with about 2.5 to about 10 moles of ethylene oxide (Neodol™ 91-2.5 or -5 or -6 or -8), $C_{12-15}$ alkanol condensed with 6.5 moles ethylene oxide (Neodol™ 23-6.5), $C_{12-15}$ alkanol condensed with 12 moles ethylene oxide (Neodol™ 25-12), $C_{14-15}$ alkanol condensed with 13 moles ethylene oxide (Neodol™ 45-13), $C_{14-15}$ alkanol condensed with about 7 moles of ethylene oxide (Neodol™ 45-7) and the like. Especially preferred for the compositions of the Present Invention is Neodol™ 91-5 in the amount of about 4 to about 7%.

Additional suitable water soluble nonionic surfactants include the condensation products of a secondary aliphatic alcohol containing 8 to 18 carbon atoms in a straight or branched chain configuration condensed with about 5 to about 30 moles of ethylene oxide. Examples of commercially available nonionic surfactants of the foregoing type include, for example: $C_{11}$-$C_{15}$ secondary alkanol condensed with either about 9 moles of ethylene oxide (Tergitol™ 15-S-9) or about 12 moles of ethylene oxide (Tergitol™ 15-S-12) (both marketed by Union Carbide (USA)). Other useful nonionic surfactants include, e.g., alkyl phenol ethoxylates include nonyl phenol condensed with about 3 to about 9.5 moles of ethylene oxide per mole of nonyl phenol; dinonyl phenol condensed with about 12 moles of ethylene oxide per mole of phenol; dinonyl phenol condensed with about 15 moles of ethylene oxide per mole of phenol and di-isoctylphenol condensed with about 15 moles of ethylene oxide per mole of phenol. Commercially available nonionic surfactants of this type include Igepal™ CO-630 (nonyl phenol ethoxylate) marketed by GAF Corporation (New York, USA).

Also among the suitable nonionic surfactants are the water-soluble condensation products of a $C_8$-$C_{20}$ alkanol with a mixture of ethylene oxide and propylene oxide wherein the weight ratio of ethylene oxide to propylene oxide is about 2.5:1 to about 4:1, preferably about 2.8:1 to about 3.3:1, with the total of the ethylene oxide and propylene oxide (including the terminal ethanol or propanol group) being about 60 to about 85%, preferably about 70 to about 80% by weight. Such surfactants are commercially available from BASF-Wyandotte (Michigan, USA).

Other nonionic surfactants useful for the present invention include condensates of about 2 to about 30 moles of ethylene oxide with sorbitan mono- and tri-$C_{10}$-$C_{20}$ alkanoic acid esters having a hydrophilic-lipophilic balance (HLB) of 8 to 14. These surfactants are well known and are available from Imperial Chemical Industries (London, UK) under the "Tween" trade name. Suitable surfactants include: polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic surfactants are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of about 950 to about 4000, preferably about 1500 to about 2,500. The addition of polyoxyethylene radicals to the hydrophobic portion tends to increase the solubility of the molecule as a whole so as to make the surfactant water-soluble. The molecular weight of the block polymers varies between about 1,000 and about 15,000 and the polyethylene oxide content may comprise about 20% to about 80% by weight. Preferably, these surfactants will be in liquid form, and satisfactory surfactants are available as grades L 62 and L 64.

The compositions of the present invention further comprise an amine surfactant. As used herein, an "amine surfactant" (or "amine co-surfactant" used interchangeably) is a surfactant comprising an amino, amine oxide or quaternary ammonium moiety. Preferably, the amine surfactants useful in the compositions of the present invention are amphipathic, surface active compounds comprising: (1) a hydrophobic end, which typically contains more than 7 carbon atoms, preferably 10-20 carbon atoms, (2) an amine hydrophilic end containing either (a) an N-oxide having formula V:

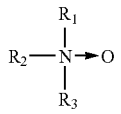

wherein $R_1$, $R_2$ and $R_3$ are independently H or optionally substituted: $C_{1-15}$ alkyl, aryl, arylamidoalkyl or alkylamidoalkyl, e.g. alkylamidopropylamine oxide, e.g. cocoamidopropylamine oxide; or (b) a zwitterionic surfactant of formula VI:

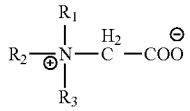

wherein $R_1$, $R_2$ and $R_3$ are independently H or optionally substituted: $C_{1-15}$ alkyl, aryl, arylamidoalkyl or alkylamidoalkyl, e.g. betaine or cocoamidopropyl betaine. In certain embodiments, the amine oxide surfactant is lauryl myristyl isopropyl amine oxide.

In certain embodiments, the compositions comprise an amine co-surfactant comprising either an amine oxide group, e.g. a alkylamine oxide or alkylamidoalkylamine oxide, e.g., cocoamidopropylamine oxide; or a zwitterionic amine group, e.g., alkylamidoalkyl betaines, e.g. cocoamidopropyl betaine, e.g., in an amount of about 3 to about 15, about 6 to about 13%, or about 7 to about 10% by weight.

In certain embodiments, the ratio by weight of (iii) anionic surfactant to (iv) amine co-surfactant is about 30:70 to about 70:30. In various embodiments, the ratio of (iii) to (iv) may be about 50:50, i.e., about 1:1. The ratio by weight of components (ii) to (v) is preferably about 30:70 to about 70:30, e.g., about 1:1 to about 1:1.5. The ratio of (ii):(iii):(iv):(v) thus may be about 1:1.5:1.5:1, e.g., wherein "about" denotes a variation of +/−30%. In certain embodiments, the compositions comprise lauryl myristyl isopropyl amine oxide and sodium $C_{12-14}$ ether sulfate in about a 60:40 weight ratio. In other embodiments, the compositions comprise cocoamidoropyl amine oxide and sodium $C_{12-14}$ ether sulfate in about a 1:1 weight ratio.

In certain embodiments, the total weight of the anionic surfactant and amine surfactant together is about 15% of the overall composition. In certain embodiments, the ratio of organic solvent to anionic surfactant to amine co-surfactant to nonionic surfactant is about 1:1.5:1.5:1. In certain embodiments, the present invention is directed to compositions comprising microemulsions, e.g., oil-in-water microemulsions or microemulsion preconcentrates. In certain embodiments, the compositions of the present invention are in the form of a microemulsion preconcentrate.

The compositions of the present invention further comprise an organic solvent. As used herein an "organic solvent" is an organic compound capable of dissolving grease. Useful organic solvents include, for example: terpenes, e.g., limonene or pinene; lower alkyl esters or diesters, e.g., dibutyl adipate, dipropyl adipate, diisopropyl adipate, mono or dimethyl adipate, or ethyl acetate; lower aliphatic alkanol, e.g., ethanol, isopropyl alcohol or butanol; optionally substituted aromatic alcohol, e.g. phenol or alkylphenol; or lower alkyl ethers and diethers, e.g., ethyl ether or glycol ethers.

In various embodiments, the organic solvent is present in amounts of about 0.1% to about 10% by weight, about 0.2 to about 5%, about 0.3 to about 3% or about 0.5 to about 2%.

The compositions of the present invention also comprise an aqueous component. As used herein, the term "aqueous" refers to a component that is hydrophilic and/or soluble in water. In various embodiments, the aqueous component is water in amounts of about 40% to about 90%, about 45% to about 85%, about 50% to about 80% and about 55% to about 75%.

Additional optional ingredients may be included to provide added effect or to make the product more attractive to the consumer. Such ingredients include, but are not limited to: perfumes or fragrances, dyes or pigments, thickening agents, abrasive agents, disinfectants, radical scavengers, bleaches, chelating agents, or mixtures thereof.

In various embodiments, the present invention is directed to methods of cleaning a hard surface comprising applying a cleaning composition as described herein to the surface and rinsing the surface with water. As used herein, "applying" may include, for example, spraying, wiping, transferring (as with a sponge or cloth), pouring or the like.

The various embodiments of the present invention may be further illustrated as described in the following non-limiting Examples:

Example 1

The following example illustrates a cleaning composition of the present invention, that was prepared by mixing the listed ingredients into a batch mixture.

| | |
|---|---|
| About 6 to about 9% | Sodium $C_{12-14}$ ether sulfate with an average of about 2 moles ethylene oxide |
| About 3 to about 15% | Cocoamidopropyl amine oxide |
| About 0.5 to about 10% | Neodol ™ 91-5 ethoxylate |
| About 0.1 to about 10% | Dibutyl adipate |
| q.s. | Water |

Example 2

Another cleaning composition in accordance with the present invention is prepared as follows, with the same procedure as above.

| | |
|---|---|
| About 7 to about 8.5% | Sodium $C_{12-14}$ ether sulfate with an average of about 2 moles ethylene oxide |
| About about 6 to about 13% | Lauryl Myristyl isopropyl amine oxide |
| About 1.5 to about 5% | Neodol ™ 91-5 ethoxylate. |
| About 0.2 to about 5% | Diisopropyl adipate |
| q.s. | Water |

In both Examples above, the above ingredients are mixed together to produce a cleaning composition in the form of a microemulsion.

What is claimed is:

1. A cleaning composition comprising:

(i) water;

(ii) about 0.1 to about 10% diisopropyl adipate or dipropyl adipate;

(iii) about 6 to about 9% C12-14 alcohol polyethylene glycol (ethoxy) ether sulfate;

(iv) about 3 to about 15% cocoamidopropylamine oxide or lauryl myristyl isopropyl amine oxide; and (v) about 3 to about 8% C9-11 alkanol with a degree of ethoxylation of 5 moles;

wherein said composition is a microemulsion or microemulsion preconcentrate.

2. The cleaning composition according to claim 1, wherein the ratio of anionic surfactant to amine oxide surfactant is a range of about 30:70 to about 70:30.

3. The cleaning composition according to claim 1, wherein the ratio of anionic surfactant to amine oxide surfactant is about 50:50.

4. The cleaning composition according to claim 1 in the form of an oil-in-water microemulsion.

* * * * *